United States Patent [19]

Ono

[11] Patent Number: 4,473,926

[45] Date of Patent: Oct. 2, 1984

[54] ADJUSTING DEVICE FOR SEAT BELT

[75] Inventor: Katsuyasu Ono, Kanagawa, Japan

[73] Assignee: NSK Warner K.K., Japan

[21] Appl. No.: 485,237

[22] Filed: Apr. 14, 1983

[30] Foreign Application Priority Data

Apr. 28, 1982 [JP] Japan ..... 57-62457[U]

[51] Int. Cl.[3] ..... A44B 11/06

[52] U.S. Cl. ..... 24/196; 24/682; 24/194

[58] Field of Search ..... 24/194, 196, 197, 200, 24/265 BC

[56] References Cited

U.S. PATENT DOCUMENTS

| | | | |
|---|---|---|---|
| 3,169,291 | 2/1965 | Stacherl | 24/196 |
| 3,407,451 | 10/1968 | Dewey et al. | 24/196 |
| 3,941,419 | 3/1976 | Blom | 24/196 |
| 4,069,554 | 1/1978 | Minolla et al. | 24/196 |
| 4,184,234 | 1/1980 | Anthony et al. | 24/196 |
| 4,386,452 | 6/1983 | Stephenson | 24/196 |
| 4,392,277 | 7/1983 | Muller | 24/196 |

*Primary Examiner*—William E. Lyddane
*Assistant Examiner*—Peter A. Aschenbrenner
*Attorney, Agent, or Firm*—Cantor and Lessler

[57] ABSTRACT

An adjusting device for a seat belt comprising: a base plate having a base and a pair of side walls, said base having a webbing inserting hole through which a webbing is passed, said pair of side walls extending upward from both sides of said base and bent toward the inside at the end portions thereof; an adjusting bar provided between said both side walls and relatively movable against the base plate; and a metal protector mounted to said base plate, said protector including a portion located above the adjusting bar.

4 Claims, 9 Drawing Figures

ADJUSTING DEVICE FOR SEAT BELT

BACKGROUND OF THE INVENTION

The present invention relates to an adjusting device for a seat belt, and particularly to a seat belt length adjusting device covered with an metal protector in order to prevent damage.

An adjusting device for seat belt used in vehicles heretofore proposed has also attempted prevention of noise generated by suppressing upward and downward or forward and backward movement of the adjusting bar for the webbing length and by preventing whatever slip may be present. But such an adjusting device for a seat belt is, of course, required to reliably hold the webbing at the adjusted position even when it is caught between the door and the vehicle body (an impact is particularly large when it is caught at the time of closing the door). Moreover the plastic part of the adjusting device may have become brittle in the winter season and accordingly may be broken easily by impact. From this point of view, it is necessary to use a protector for such an adjusting device for a seat belt.

SUMMARY OF THE INVENTION

The present invention has been created in light of the above considerations and has for its object to provide an adjusting device, which does not affect the function of clamping the webbing in the adjusting position even when an impact is applied.

According to the invention, there is provided an adjusting device for a seat belt comprising: a base plate having a base and a pair of side walls, said base having a webbing inserting hole through which a webbing is passed, said pair of side walls extending upward from both sides of said base and bent toward the inside at the end portions thereof; an adjusting bar provided between both said side walls and relatively movable against the base plate; and a metal protector mounted to said base plate, said protector including a portion located above the adjusting bar.

BRIEF DESCRIPTION OF THE DRAWINGS

The present invention will be well understood from the following description taken in connection with the accompanying drawings in which.

DETAILED DESCRIPTION OF THE PREFERRED EMBODIMENT

Figure 1:
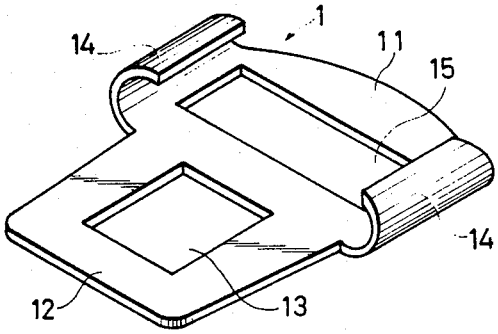
FIG. 1 is a perspective view of the base plate.

Now returning to the abovementioned figures, FIG. 1 is a perspective view of the base plate 1 through which the webbing is extended, where the base plate 1 is composed of the base 11 providing the webbing inserting hole 15 therein and the tongue portion 12 protruding in front of said hole. (In the following description, the tongue side is assumed as forward, while the base side as rearward.) Both sides of the base are bent upward, forming curved side walls 14 and the webbing inserting hole 15 is prepared between said side walls. 13 is the engaging hole in the tongue portion 12. This tongue portion 12 is inserted into the corresponding buckle. This buckle is a well-known means and explanation is omitted here.

Figure 2:
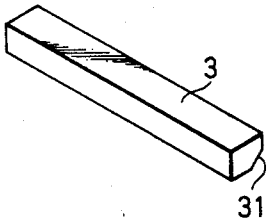
FIG. 2 is a perspective view of the adjusting bar.

FIG. 2 shows the adjusting bar for clamping the webbing, having the cross-section which is not rectangular but providing the rear lower part 31 allowing a little amount of cut-away portion.

Figure 3:
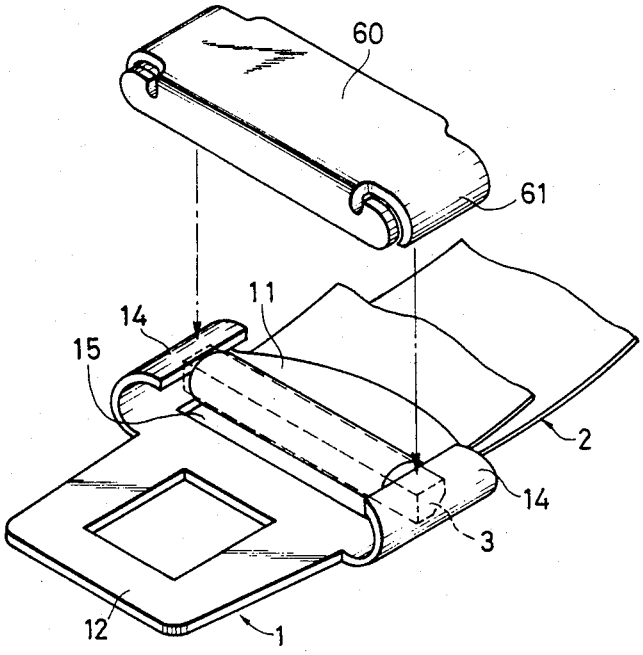
FIG. 3 shows a combination of the base plate and webbing.
Figure 4:
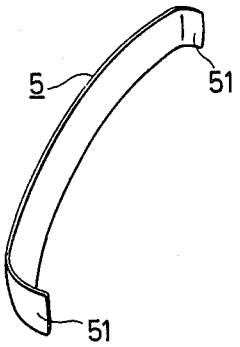
FIG. 4 is a perspective view of the leaf spring.
Figure 5:
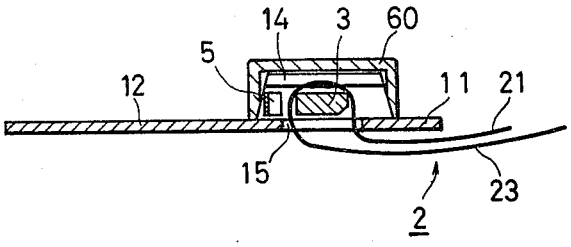
FIG. 5 is a schematic diagram of a combination of the base plate and webbing.
Figure 6:
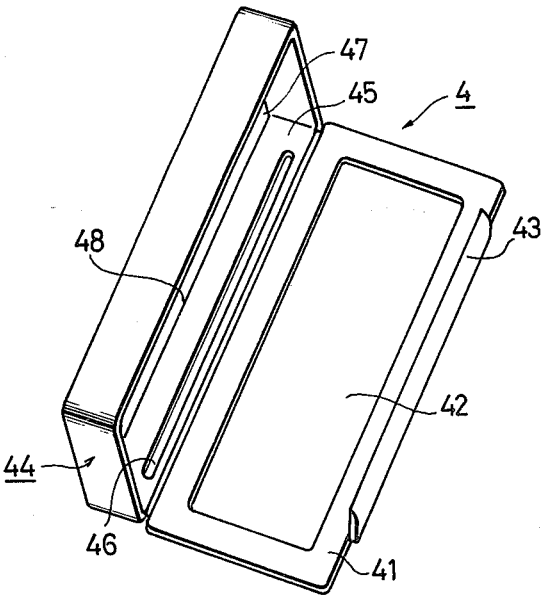
FIG. 6 is a perspective view of the cover member.

FIG. 3 shows a profile where the webbing 2 is applied through the base plate 1. The adjusting bar 3 is placed between the side walls 14 of the base plate 1. The webbing 2 is extended to the webbing inserting hole 15 from the lower side behind the adjusting bar and is pulled backward again passing the hole 15 after turning around the adjusting bar from the forward of adjudting bar. In the case of this invention, a metal (iron, preferably) protector 60 is fixed at the upper portion of both side walls 14 as indicated by the dot-chain line of FIG. 3. When the adjusting bar 3 moves forward and backward in this structure, it causes a little amount of slip and therefore the leaf spring 5 as shown in FIG. 4 is placed in front of the adjusting bar on the base plate 1 and thereby this leaf spring is accommodated within the protector when it is fixed over both side walls. This schematic view of this condition is shown in FIG. 5. Namely, the end point of free end portion 21 of the webbing 2 is extended and wound about the adjusting bar 3 from the lower side of the base plate 1 passing through the webbing inserting hole 15 and then such free end portion 21 is pulled backward again passing through the inserting hole 15. In the figure, 23 is the portion of webbing contacting the user's body. The webbing can be fastened tightly when the free end portion 21 is pulled. When the portion 23 which is closely in contact with the user's body is pulled toward the right, the adjusting bar 3 is pulled backward, thereby pulling the webbing tighter and taking up any slack. As explained above, the adjusting bar 3 is prevented from movement by pressing the bar 3 backward with the holding portions 51 in the right and left sides of the leaf spring 5, but in the case of this embodiment, this base plate 1 is further covered with the covering member 4 shown in FIG. 6. The covering member 4 is made of synthetic resin having a certain degree of elastic property and is composed of the bottom plate 41 and the cover 44 which is provided integrally with the bottom plate 41 and is movable against it. The bottom plate 41 is provided with the webbing inserting hole 42 and also with the locking hook 43 which locks the cover when it is in place. The cover 44 is provided with a tongue inserting hole 46 at the boundary of the side plate 45 near the bottom plate 41 and the side plate 45 and top plate 47 are in contact with each other along the side 48.

Figure 7:
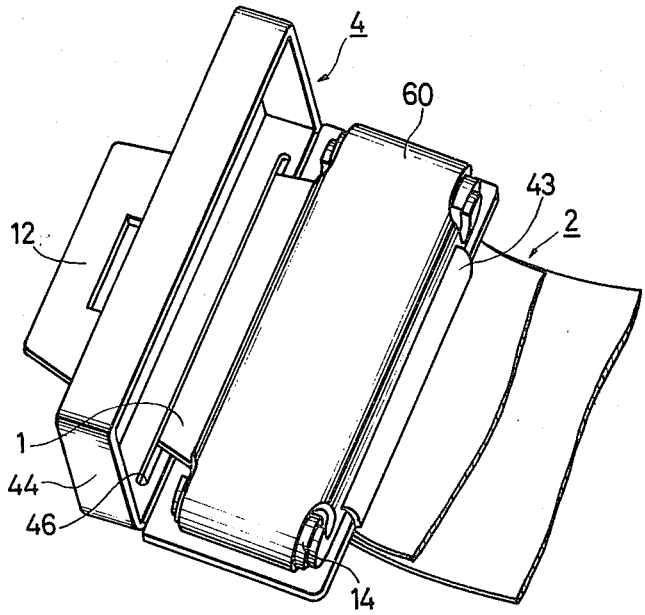
FIG. 7 shows a combination of the base plate, cover member, protector and webbing.
Figure 8:
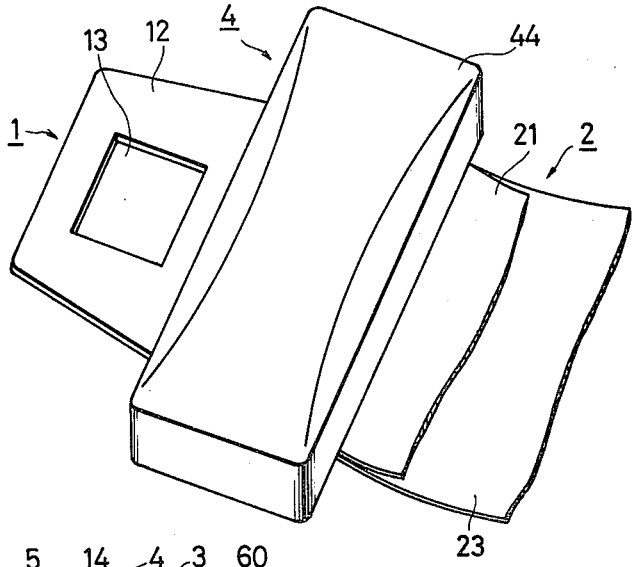
FIG. 8 shows the condition where the present invention is practically used.
Figure 9:
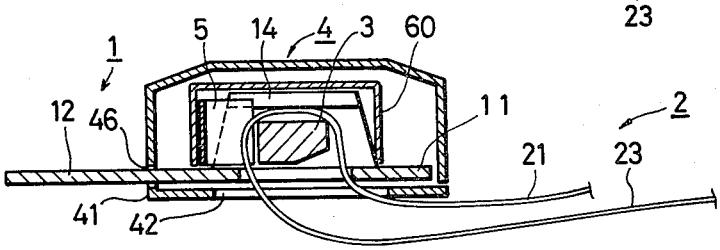
FIG. 9 shows a schematic diagram of the present invention being used practically.

FIG. 7 shows a profile where the base plate 1 to which the protector 60 is placed from the upper side and the covering member 4 are combined. As shown in FIG. 3, the webbing 2 is applied through to the base plate 1, the base plate 1 is placed on the bottom plate 41, the tongue portion 12 is extended from the tongue inserting hole 46 and the webbing 2 is extended to the lower side from the webbing inserting hole 42. Then, the cover 44 is rotated toward the base plate and is locked by the locking hook 43. Thereby, the condition shown in FIG. 8 can be obtained. This condition will be explained by referring to FIG. 9 where it is indicated schematically. The base 11 of the base plate 1 is placed on the bottom plate 41 of the covering member, and the tongue portion 12 is protruded toward outside from the tongue inserting hole 46 and the protector 60 is engaged from the upper side of the base plate 1. At this time, both right and left ends 61 of the protector 60 are firmly engaged to the side walls 14 of the base plate 1. (Refer to FIG. 3.) The leaf spring 5 is inserted into the front side of the adjusting bar within the protector. Thereby, the adjusting bar doesn't move forward or backward because it is urged by the holding portions 51 on both right and left sides of the leaf spring 5. In addition, the adjusting device as a whole is accommodated within the cover 4.

The present invention provides the above-mentioned structure and thereby realizes an adjusting device whose function is not affected, even when it receives an impact or its cover is broken.

What is claimed is:

1. An adjusting device for a seat belt comprising:

a base plate having a base and a pair of side walls, said base having a webbing inserting hole through which a webbing is passed, said pair of side walls curving upwardly and inwardly from both sides of said base;

an adjusting bar provided between both said side walls and relatively movable against the base plate, said adjusting bar having a cross section which is generally rectangular with one corner truncated; and a metal protector mounted to said base plate, said protector including a top portion located above the adjusting bar and a pair of side walls curving downwardly and inwardly to clamp over the respective side walls of said base plate.

2. An adjusting device for a seat belt according to claim 1, wherein activating means which activates the adjusting bar in the direction of clamping the webbing is provided in the area between said protector and adjusting bar.

3. An adjusting device for a seat belt comprising:

a base plate having a base and a pair of side walls, said base having a webbing inserting hole through which a webbing is passed, said pair of side walls curving upwardly and inwardly from both sides of said base;

an adjusting bar provided between both said side walls and relatively movable against the base plate, said adjusting bar having a cross section which is generally rectangular with one corner truncated;

a covering member being made of a synthetic resin adapted for covering said adjusting bar;

a metal protector provided between said base plate and covering member, said protector including a portion located above the adjusting bar and a pair of side walls curving downwardly and inwardly to clamp over the respective side walls of said base plate.

4. An adjusting device for a seat belt according to claim 3, wherein activating means which activates the adjusting bar in the direction of clamping the webbing is provided in the area between said protector and adjusting bar.

* * * * *